US005704167A

United States Patent [19]

Swinderman

[11] Patent Number: 5,704,167

[45] Date of Patent: Jan. 6, 1998

[54] REMOVABLE ACCESS DOOR WITH MULTIPLE PIVOT AXES

[75] Inventor: R. Todd Swinderman, Kewanee, Ill.

[73] Assignee: Martin Engineering Company, Neponset, Ill.

[21] Appl. No.: 629,510

[22] Filed: Apr. 9, 1996

[51] Int. Cl.[6] ..... E05D 7/02

[52] U.S. Cl. ..... 49/381; 16/229; 16/230; 16/231; 16/386; 49/382

[58] Field of Search ..... 49/381, 382, 192, 49/193, 388, 399, 463, 402, 465, 475.1; 16/229, 230, 231, 386

[56] References Cited

U.S. PATENT DOCUMENTS

| | | | |
|---|---|---|---|
| 3,298,135 | 1/1967 | Kinser | 49/382 |
| 3,486,272 | 12/1969 | Eigenmann et al. | 49/192 |
| 3,861,083 | 1/1975 | Goiot | 49/193 |
| 4,455,711 | 6/1984 | Anserson | 16/386 |
| 4,532,673 | 8/1985 | Kim | 49/192 |
| 4,573,567 | 3/1986 | Swinderman . | |
| 4,593,493 | 6/1986 | Naka et al. . | |
| 4,745,708 | 5/1988 | Roche . | |
| 4,878,314 | 11/1989 | Blockinger | 49/381 |
| 5,274,881 | 1/1994 | DeRosa | 16/230 |
| 5,311,824 | 5/1994 | Sauer et al. . | |
| 5,358,291 | 10/1994 | Malmanger et al. . | |

FOREIGN PATENT DOCUMENTS

| | | | |
|---|---|---|---|
| 625553 | 9/1961 | Italy | 49/192 |

OTHER PUBLICATIONS

IBM Double–Hinged Cover, M.A. Lockhart, vol. 7 No. 9, Feb. 1965.

*Primary Examiner*—Kenneth J. Dorner
*Assistant Examiner*—Curtis Cohen
*Attorney, Agent, or Firm*—Lee, Mann, Smith, McWilliams, Sweeney & Ohlson

[57] ABSTRACT

A hinged access door arrangement is provided which includes a flange member adapted to be secured to a housing which defines an aperture therethrough to provide access to the housing. A cover member is adapted to overly the aperture when in a closed position. A plurality of first hinge members are attached to the cover member at a plurality of locations around the cover member. Each first hinge member is adapted to form part of a hinge mechanism to provide selective pivotal movement of the cover member about a respective axis. A plurality of second hinge members are attached to the flange member at a plurality of locations around the flange member. Each second hinge member is positioned to cooperate with a first hinge member to form part of a hinge mechanism. A first hinge pin pivotally connects a selected first one of the first hinge members to a second hinge member to form a first hinge mechanism having a first pivot axis about which the cover member is selectively pivotal. A second attachment member is adapted to pivotally a selected second one of the first hinge members to a second hinge member to form a second hinge mechanism having a second pivot axis about which the cover member is selectively pivotal. The selective engagement of the first attachment member with the first and second hinge members determines the location of the first pivot axis from a plurality of possible locations, and the selective disengagement of the first attachment member eliminates the hinge function to allow the selective removal of the cover member from the flange member.

21 Claims, 1 Drawing Sheet

REMOVABLE ACCESS DOOR WITH MULTIPLE PIVOT AXES

BACKGROUND OF THE INVENTION

The present invention is directed to an access door for providing selective access to the interior of a conveyor housing or other enclosure, and in particular to an access door which is selectively pivotal about one of a plurality of axes and which is also selectively removable from the housing.

Access doors for conveyor housings and other enclosures typically include a door which is attached to the housing for pivotal movement about a predetermined single axis. Once installed, the pivot axis of these access doors can not be relocated to allow the door to open in a different direction. Thus when existing equipment is retrofitted or new equipment is installed adjacent to equipment having an access door, the access door may become blocked against fully opening about its predetermined pivot axis, although the door could still be fully opened if the location of the pivot axis could be changed. The present invention overcomes these problems.

SUMMARY OF THE INVENTION

An access door arrangement is provided which permits access to the interior of a housing. The access door arrangement includes a flange member adapted to be secured to the wall of a housing. The flange member includes an aperture which provides a passageway through the flange member and wall of the housing to the interior of the housing. The access door arrangement includes a cover member which is adapted to overly the aperture of the flange member, when in a closed position, to limit access to the housing. A plurality of first hinge members are attached to the cover member at a plurality of locations around the cover member. Each first hinge member is adapted to form part of a hinge mechanism between the flange member and the cover member. Each first hinge member is adapted to provide selective pivotal movement of the cover member between an open position and a closed position about a respective axis, such that the cover member may be selectively pivoted in a selected one of a plurality of different directions about an axis of one of the first hinge members. A plurality of second hinge members are attached to the flange member at a plurality of locations around the flange member. Each second hinge member is positioned to cooperate with a first hinge member to selectively form part of a hinge mechanism between the flange member and the cover member. A first attachment member is adapted to pivotally connect a selected first one of the plurality of first hinge connector members to one of the second hinge members to form a first hinge mechanism between the cover member and the flange member. The first hinge mechanism includes a first pivot axis about which the cover member is selectively pivotal. The first attachment member is adapted to selectively release the selected first hinge connector member from the second hinge connector member when desired. A second attachment member is adapted to pivotally connect a selected second one of the first hinge connector members to one of the second hinge connector members so as to form a second hinge mechanism between the cover member and the flange member. The second hinge mechanism includes a second pivot axis about which the cover member may be selectively pivoted. The second attachment member is adapted to selectively release the selected second one of the first hinge connector members from the second hinge connector member when desired.

The selective engagement of the first attachment member with the first and second hinge connector numbers determines the location of a first pivot axis of the cover member from among a member of possible locations. The selective engagement of the second attachment number with the selected first and second hinge connector members determines the location of a second pivot axis about which the cover member may pivot from among a number of possible locations. The cover member may be selectively pivoted about the first pivot axis upon the removal of the second attachment member. Alternatively, the cover member may be selectively pivoted about the second pivot axis upon the selective removal of the first attachment member. The cover member may also be removed in its entirety from the flange member and the housing by the removal of all of the attachment members.

DETAILED DESCRIPTION OF THE PREFERRED EMBODIMENT

Figure 1:
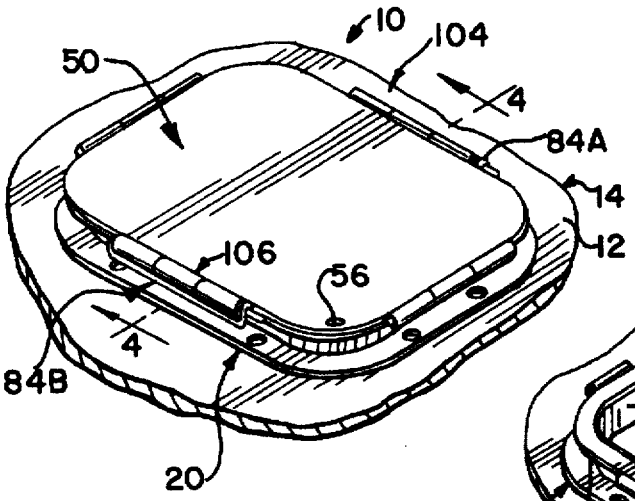
FIG. 1 is a perspective view of one embodiment of the access door arrangement of the present invention shown attached to a housing with the cover member shown in a closed and locked position.

The access door arrangement 10, as shown in FIGS. 1–4, is adapted to be attached to a wall 12 of a base member such as a housing 14. The housing 14 may be a conveyor housing, bin, silo, or other type of enclosure.

The access door 10 includes a portal frame 20 having an aperture 22 which is adapted to provide a passageway through the portal frame 20 and wall 12 to the interior of the housing 14. The portal frame 20 includes a generally tubular collar or web 24 which forms the aperture 22. The web 24 includes a lower circumferential edge 26 and an upper circumferential edge 28. A lower flange 30 is attached to the lower edge 26 of the web 24 and extends outwardly from and generally perpendicular to the web 24. The lower flange 30 extends around the entire circumference of the web 24 along the lower edge 26. The lower flange 30 includes a plurality of apertures 32 which are adapted to facilitate the attachment of the portal frame 20 to the wall 12 of the housing 14 with fasteners such as nuts and bolts. An upper flange 34 is attached to the upper edge 28 of the web 24 and extends outwardly from and generally perpendicular to the web 24. The upper flange 34 extends around the entire circumference of the web 24 along the upper edge 28.

The upper flange 34 includes a peripheral edge 36. The frame 20 as shown in the drawing figures is generally rectangular and includes a plurality of generally rectangular sides 40A–D. The sides 40A and 40C oppose one another and the sides 40B and 40D oppose one another. The frame 20 may alternately be circular, square, or other shapes as desired. If the portal frame 20 was formed in a circular manner, it would include a plurality of locations around its perimeter which are equivalent to rectilinear sides in a polygonal-shaped portal frame.

Figure 2:
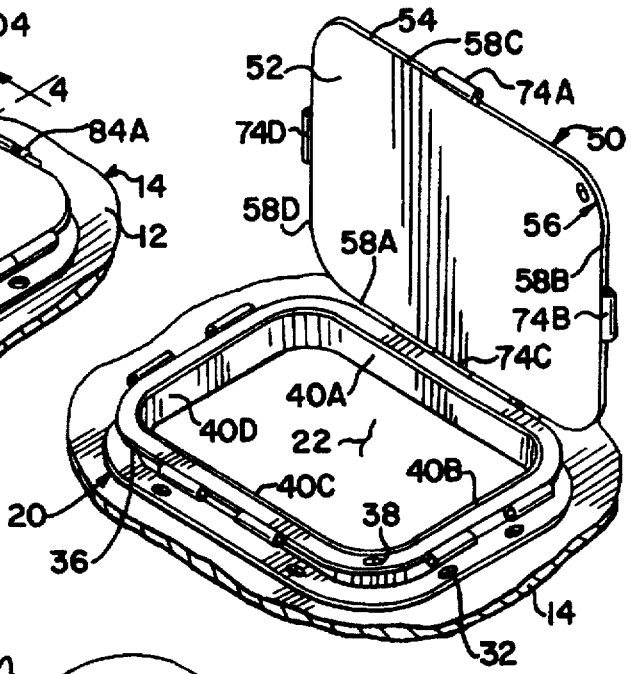
FIG. 2 is a perspective view of the access door arrangement shown with the cover member pivoted about an axis to an open position.
Figure 4:
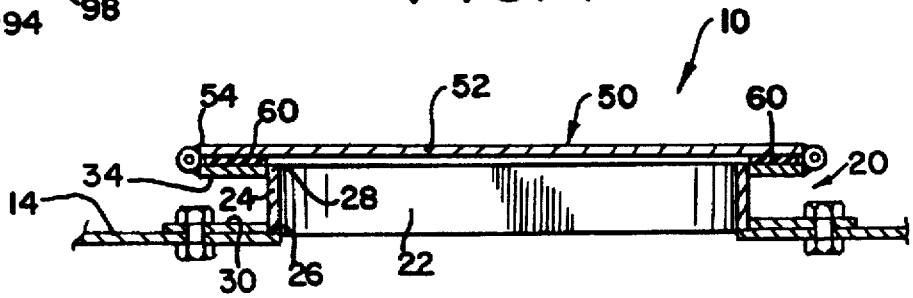
FIG. 4 is a cross-sectional view of the access door arrangement taken along lines 4—4 of FIG. 1.

As best shown in FIG. 2, the upper flange 34 includes an aperture 38 extending through a corner thereof. The upper flange 34 may include additional apertures 38 if desired. For example, an aperture 38 may be located in each corner of the upper flange 34. If desired, a sealing gasket (not shown) may be provided between the lower surface of the lower flange 30 and the wall 12 of the housing 14 to provide a seal therebetween. As best shown in FIG. 4, the web 24, lower flange 30 and upper flange 34 form a generally C-shaped cross section. The frame 20 may be made from various types of metals or from various types of plastics, such as high impact plastics.

The access door 10 also includes a closure or cover member 50. The cover member 50 includes a generally planar plate 52 having a peripheral edge 54. As best shown in FIGS. 1 and 4, the plate 52 is adapted to overly the aperture 22 and upper flange 34 of the frame 20 such that the peripheral edge 54 of the plate 52 is substantially aligned in juxtaposition with the peripheral edge 36 of the upper flange 34 about its entire circumference. The cover member 50 thus conforms to the general shape of the upper flange 34. The preferred embodiment of the cover member 50, as shown, is generally rectangular and includes a plurality of sides 58A–D which correspond respectively to the sides 40A–D of the frame 20. The cover member 50 is shown in the drawing figures as comprising a single plate 52. However, if desired the cover member 50 can be formed from a plurality of plates, each of which is adapted to overly a specific portion of the aperture 22. The plate 52 may include an aperture 56 which is adapted to be coaxially aligned in juxtaposition with the aperture 38 in the frame 20 when the cover member 50 is in the closed position as shown in FIG. 1. The apertures 38 and 56 form a passageway through the upper flange 34 and plate 52 through which a padlock or other locking device may be inserted to prevent opening of the cover member 50 except by authorized personnel. A sealing gasket 60 is preferably located between the outer surface of the upper flange 34 and the interior surface of the plate 52 to provide a seal therebetween. The cover member 50 may be made from various types of metals or various types of plastics such as high impact plastics.

The access door 10 includes a plurality of hinge connector members such as frame hinge members 64A–D attached to the peripheral edge 38 of the upper flange 34 of the frame 20 at a plurality of locations around the upper flange 34. The frame hinge member 64A is located on the side 40A of the frame 20, the frame hinge member 64B is located on the side 40B, the frame hinge member 64C is located on the side 40C, and the frame hinge member 64D is located on the side 40D of the frame 20. Each frame hinge member 64A–D preferably includes two axially aligned and spaced apart tubular members 66. Each tubular member 66 includes a longitudinally extending, generally cylindrical bore. The bores of the tubular members 66 of the frame hinge member 64A are coaxially aligned about a pivot axis 68A. The bores of the tubular members 66 of the frame hinge member 64B are coaxially aligned about a pivot axis 68B. The bores of the tubular members 66 of the frame hinge member 64C are coaxially aligned about a pivot axis 68C. The bores of the tubular members 66 of the frame hinge member 64D are coaxially aligned about a pivot axis 68D. The pivot axes 68A and 68C are spaced apart and generally parallel to one another and generally perpendicular to the pivot axes 68B and 68D. The pivot axes 68B and 68D are spaced apart and generally parallel to one another and perpendicular to the pivot axes 68A and 68C. While each frame hinge member 64A–D is shown as including two spaced apart tubular members 66, each frame hinge member 64A–D may alternatively include only a single tubular member 66 or additional spaced apart and coaxially aligned tubular members 66. While the frame hinge members 64A–D are preferably attached to the frame 20, if desired, the frame 20 may be eliminated and the frame hinge members 64A–D can be attached directly to the wall 12 of the housing 14.

The access door 10 also includes a plurality of hinge connector members such as cover hinge members 74A–D. The cover hinge members 74A–D are attached to the peripheral edge 54 of the plate 52 at a plurality of locations around the cover member 50. The cover hinge members 74A–D are respectively located on each of the sides 58A–D of the cover member 50. Each of the cover hinge members 74A–D are positioned on the cover member 50 to cooperate with a respective frame hinge member 64A–D to form part of a hinge mechanism between the flange 34 and the cover member 50. Each cover hinge member 74A–D includes a tubular member 76 which includes a longitudinally extending generally cylindrical bore. When the cover member 50 is in the closed position, as shown in FIG. 1, the tubular member 76 of each cover hinge member 74A–D is adapted to be respectively located between the spaced apart tubular members 66 of the frame hinge members 64A–D, such that the bores of the tubular members 66 and 76 are coaxially aligned with one another. While each cover hinge member 74A–D is shown as including one tubular member 76, each cover hinge member 74A–D can include additional spaced apart and coaxially aligned tubular members 76 if desired. The cover hinge members 74A–D are adapted to respectively provide pivotal movement of the cover member 50 between open and closed positions about the pivot axes 68A–D.

Figure 3:
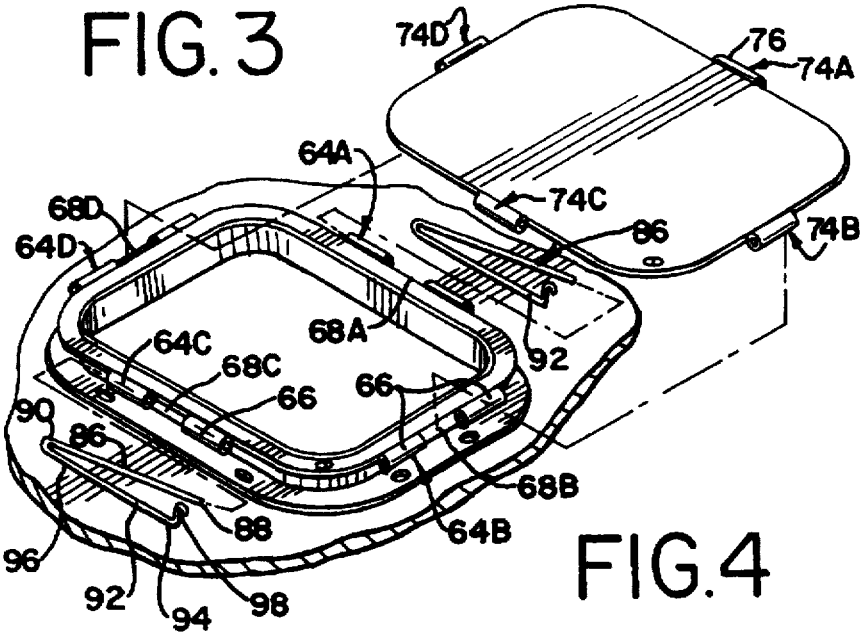
FIG. 3 is a perspective view of the access door arrangement with the hinge pins and cover member removed from the frame.

The access door 10 also includes one or more hinge attachment members such as hinge pins 84A–B. Only one hinge pin 84 is required for operation but, for convenience, a plurality of them may be supplied. As best shown in FIG. 3, each hinge pin 84A–B includes a first leg 86 having a first end 88 and a second end 90. The first leg 86 is elongate and generally rectilinear and cylindrical. The first leg 86 is adapted to extend within the aligned bores of the frame hinge members 64A–D and of the cover hinge members 74A–D, and to be selectively slidable therein along the respective pivot axes 68A–D. Each hinge pin 84A–B aim preferably includes a second leg 92 having a first end 94 and a second end 96. The second leg 92 is elongate and generally rectilinear and cylindrical. The second end 96 of the second leg 92 is attached to the second end 90 of the first leg 86 such that the hinge pin is generally U-shaped or V-shaped. The second end 96 of the second leg 92 includes a hook member 98 which is adapted to selectively attach the second end 96 of the second leg 92 to the first end 88 of the first leg 86. The second leg 92 is resilient such that the second leg 92 biases the hook member 98 into continuing engagement with the first leg 86 once the hook member 98 is placed into interlocking engagement with the first leg 86. The hook member 98 is selectively releasable from the first leg 86 to allow sliding removal of the first leg 86 from the frame hinge members 64A–D and cover hinge members 74A–D. In operation, the first leg 86 of the hinge pin 84A may be slidably inserted through the bores of the aligned frame hinge member 64A and cover hinge member 74A, or frame hinge member 64B and cover hinge member 74B, or frame hinge member 64C and cover hinge member 74C, or frame hinge member 64D and cover hinge member 74D. As shown in FIG. 1, the hinge pin 84A is inserted within the bores of the frame hinge members 64A and the cover hinge member 74A thereby forming a hinge mechanism 104 which is adapted to allow selective pivotal movement of the cover member 50 between a closed position, as shown in FIG. 1, and an open position as shown in FIG. 2 about the hinge pin 84A and the pivot axis 68A. This essentially completes a hinge mechanism. The hinge pin 84B can be slidably inserted through the bores of any one of the remaining aligned pairs of frame hinge member 64B and cover hinge member 74B, or frame hinge member 64C and cover hinge member 74C, or frame hinge member 64D and cover hinge member 74D to prevent opening of the cover. As shown in FIG. 1, the hinge pin 84B is inserted through the bores of the frame hinge member 64C and the cover hinge member 74C to form a hinge mechanism 106. The hinge mechanism 106 allows selective pivotal movement of the cover member 50 about the hinge pin 84D and the pivot axis 68C between the closed position and an open position. When both hinge pins 84A and 84B are inserted to form the hinge mechanisms 104 and 106 as shown in FIG. 1, the hinge pin 84B locks the cover member from pivotal movement about the hinge pin 84A and pivot axis 68A, and the hinge pin 84A prevents pivotal movement of the cover member 50 about the hinge pin 84B and pivot axis 68C. As shown in FIG. 1, the hinge pin 84B is slidable along the pivot axis 68C until the cover hinge member 74 is released from the frame hinge member 63C, whereupon the cover member 50 can be selectively pivoted about the pivot axis 68A. The hinge pin 84A can similarly be slid along the pivot axis 68A to disengage the cover hinge member 74A from the frame hinge member 64A to allow selective pivotal movement of the cover hinge member 50 about the pivot axis 68C.

The access door 10 may be configured to selectively pivot about any pivot axis 68A–D by the insertion of the hinge pin 84A through the desired frame hinge member and cover hinge member which form the desired pivot axis. The insertion of the hinge pin 84B through a remaining frame hinge member and cover hinge member will prevent pivotal movement of the cover member about the hinge pin 84A, while allowing pivotal movement of the cover member 50 about the hinge pin 84B upon removal of the hinge pin 84A. Thus the access door 10 can be configured such that the cover member 50 may be selectively pivotal between a closed and open position about the pivot axis 68A in an upward direction, about the pivot axis 68B to the right, about the pivot axis 68C in a downward direction, or about the pivot axis 68D to the left as desired. Alternatively, all of the hinge pins 84A–B can be removed from the frame hinge members 64A–D and cover hinge members 74A–D to allow the complete removal of the cover member 50 from the frame hinge member 64A–D and frame 20. Such a complete removal of the cover member 50 can be performed with less than one-inch of clearance on the outer side of the cover member 50. Additional hinge pins (not shown) may be used in connection with the access door 10 to form additional hinge mechanisms. For example, a hinge pin could be respectively inserted through each of the aligned frame hinge members 64A–D and cover hinge members 74A–D to form four hinge mechanisms. Removal of any three hinge pins will allow pivotal movement of the cover member 50 about the remaining hinge pin.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A selectively variable, pivotally hinged access door arrangement including:

a frame member adapted to be secured to a housing, said frame member defining an aperture therethrough to provide access to the housing;

a cover member adapted to overlie said aperture of said frame member when in a closed position to thereby limit access to the housing;

at least three first hinge connector means attached to said cover member at a plurality of locations around said cover member, each said first hinge connector means adapted to form part of a hinge mechanism between said frame member and said cover member, each said first hinge connector means adapted to provide selective pivotal movement of said cover member about a respective axis to enable pivoting of said cover member in different directions;

at least three second hinge connector means attached to said frame member at a plurality of locations around said frame member, each said second hinge connector means positioned to cooperate with a first hinge connector means to form part of a hinge mechanism between said frame member and said cover member;

a first attachment means adapted to pivotally connect a selected first one of any of said at least three first hinge connector means to one of said second hinge connector means so as to form a first hinge mechanism between said cover member and said frame member having a first pivot axis about which said cover member is selectively pivotal, said first attachment means adapted to be selectively removable from said selected first one of said first hinge connector means and said second hinge connector means to thereby selectively release said selected first one of said first hinge connector means from said second hinge connector means when desired;

a second attachment means adapted to pivotally connect a selected second one of said at least three first hinge connector means to one of said second hinge connector means so as to form a second hinge mechanism between said cover member and said frame member having a second pivot axis about which said cover member is selectively pivotal, said first pivot axis being distinct from said second pivot axis, said second attachment means adapted to be selectively/removable from said selected second one of said first hinge connector means and said second hinge connector means to thereby selectively release said selected second one of said first hinge connector means from said second hinge connector means when desired;

whereby the selective engagement of said first attachment means with said selected first one of said first and second hinge connector means determines the location of said first pivot axis from among a number of possible locations and the selective disengagement of said second attachment means allows selective pivotal movement of said cover member about said first pivot axis, and the selective removal of said first and second attachment means from their respective associated first and second hinge connector means allows the selective removal of said cover member from said frame member.

2. The access door arrangement of claim 1 wherein said first pivot axis is located at substantially 90° to said second pivot axis.

3. The access door arrangement of claim 1 wherein said first pivot axis is substantially parallel to, but laterally spaced from, said second pivot axis.

4. The access door arrangement of claim 1 including means for selectively preventing removal of said first attachment means from said selected first one of said first hinge connector means and said second hinge connector means while permitting selective pivotal movement of said cover member about said first pivot axis.

5. The access door arrangement of claim 1 wherein each said first hinge connector means comprises a first hinge member attached to said cover member.

6. The access door arrangement of claim 5 wherein said first attachment means comprises a first hinge pin adapted to removably and pivotally attach a selected one of said first hinge members to a first one of said second hinge connector means.

7. The access door arrangement of claim 6 wherein each said second hinge connector means comprises a second hinge member attached to said frame member, each said second hinge member adapted to be selectively pivotally attached to a respective first hinge member by said first hinge pin.

8. The access door arrangement of claim 6 wherein said second attachment means comprises a second hinge pin adapted to selectively and pivotally attach a selected second one of said first hinge members to a second one of said second hinge connector means.

9. The access door arrangement of claim 7 wherein said first and second hinge members are each generally tubular.

10. The access door arrangement of claim 7 wherein each said first and second hinge member includes a respective bore extending therethrough, each said bore of a first hinge member adapted to be generally coaxially aligned with a bore of a respective second hinge member.

11. The access door arrangement of claim 10 wherein said first hinge pin includes a first leg having a first end and a second end, said first leg adapted to extend within said bores of a first and second hinge member and to be selectively slidable within said bores of said first and second hinge members.

12. The access door arrangement of claim 11 wherein said first hinge pin includes a second leg having a first end and a second end, said second end of said first leg being attached to said second end of said second leg.

13. The access door arrangement of claim 12 wherein said first hinge pin includes means for selectively attaching said first end of said first leg to said first end of said second leg.

14. The access door arrangement of claim 1 wherein said frame member includes a first aperture and said cover member includes a second aperture adapted to be aligned in juxtaposition with said first aperture such that a locking mechanism can be inserted through said first and second apertures to selectively lock said cover member to said frame member.

15. The access door arrangement of claim 1 including a sealing gasket located between said cover member and said frame member adapted to create a seal therebetween when said cover member is in said closed position.

16. An access door arrangement for selectively covering a passageway extending through a base member, said access door arrangement including:

a closure member adapted to selectively cover the passageway;

a first hinge member, a second hinge member and a third hinge member attached to said closure member;

a first attachment means for removably and pivotally attaching a selected first one of said first, second and third hinge members to the base member, said first attachment means adapted to provide selective pivotal movement of said closure member about a first axis, said first attachment means being selectively slidable along said first axis with respect to said selected first one of said first, second and third hinge members for selectively releasing said selected first one of said first, second and third hinge members from the base member;

a second attachment means for removably and pivotally attaching a selected second one of said first, second and third hinge members to the base member, said second attachment means adapted to provide selective pivotal movement of said closure member about a second axis, said second attachment means being selectively slidable along said second axis with respect to said selected second one of said first, second and third hinge members for selectively releasing said selected second one of said first, second and third hinge members from the base member;

whereby said closure member may be selectively pivoted between an open position and a closed position about one of said first or second axes.

17. The access door arrangement of claim 16 wherein said first hinge member is generally tubular.

18. The access door arrangement of claim 16 wherein said first hinge member includes a bore extending along said first axis.

19. The access door arrangement of claim 18 wherein said first attachment means comprises a hinge pin, said hinge pin being selectively slidable within said bore of said first hinge member.

20. The access door arrangement of claim 19 wherein said hinge pin includes means for selectively preventing the release of said first hinge member from the base member while allowing pivotal movement of said closure member about said first axis.

21. The access door arrangement of claim 16 including a frame member adapted to be attached to the base member, said first attachment means removably and pivotally attaching said first hinge member to said frame member.

* * * * *